US008322562B2

(12) United States Patent
Dybala

(10) Patent No.: US 8,322,562 B2
(45) Date of Patent: Dec. 4, 2012

(54) BELLOWS BEVERAGE LID

(75) Inventor: Philip R. Dybala, Chicago, IL (US)

(73) Assignee: Fine Line Contracting Corp., Chicago, IL (US)

( * ) Notice: Subject to any disclaimer, the term of this patent is extended or adjusted under 35 U.S.C. 154(b) by 785 days.

(21) Appl. No.: 12/149,385

(22) Filed: Apr. 30, 2008

(65) Prior Publication Data

US 2009/0272742 A1 Nov. 5, 2009

(51) Int. Cl.
*A47G 19/22* (2006.01)

(52) U.S. Cl. ..... 220/711; 220/703; 222/574

(58) Field of Classification Search ..... 220/713, 220/711, 212, 703, 715, 203.04, 461, 662; 222/574, 527; 150/0.5; 5/72
See application file for complete search history.

(56) References Cited

U.S. PATENT DOCUMENTS

| | | | | |
|---|---|---|---|---|
| 3,557,995 | A | 1/1971 | Mirasol, Jr. et al. | |
| 4,331,225 | A | 5/1982 | Bolger | |
| 4,428,498 | A | 1/1984 | Obey | |
| 4,572,412 | A | 2/1986 | Brach et al. | |
| 4,609,113 | A * | 9/1986 | Seki | 215/382 |
| 5,170,910 | A | 12/1992 | Hamm | |
| 5,409,131 | A | 4/1995 | Phillips et al. | |
| 5,762,230 | A * | 6/1998 | Policappelli | 220/62.12 |
| 5,779,082 | A * | 7/1998 | Miramon | 220/212 |
| 6,318,584 | B1 | 11/2001 | Milan | |
| 6,471,085 | B1 * | 10/2002 | Gallo | 220/501 |
| 6,488,173 | B2 | 12/2002 | Milan | |
| 6,679,397 | B2 * | 1/2004 | Smith et al. | 220/254.1 |
| 7,124,917 | B2 * | 10/2006 | Lee | 222/485 |
| 7,185,784 | B2 | 3/2007 | Connors, Jr. et al. | |
| 2004/0031797 | A1 | 2/2004 | Farnsworth et al. | |
| 2004/0238542 | A1 | 12/2004 | Camp, Jr. et al. | |
| 2005/0205588 | A1 * | 9/2005 | Pitts | 220/713 |
| 2007/0164025 | A1 * | 7/2007 | McCandlish et al. | 220/212 |

FOREIGN PATENT DOCUMENTS

JP 2001-120414 5/2001

OTHER PUBLICATIONS

Website, http://www.mysimon.com/9015-11034_8-27667538.html, advertisement for Clemson Tigers Collapsible Trashcan/Cooler from Logo Inc., three pages printed from the internet on Jul. 2, 2007.

* cited by examiner

*Primary Examiner* — David Fidei
*Assistant Examiner* — Raven Collins
(74) *Attorney, Agent, or Firm* — Richard C. Litman

(57) ABSTRACT

The bellows beverage lid is a lid for a hot liquid container that has a hole or port for sipping a beverage and a bellows portion incorporated into its central beverage cover region. Pushing on the bellows portion causes air to be forced in and out of the hot liquid container. The collapsible bellows allows a user to cool the liquid held in the container without the necessity of removing the lid and risking the possible spills or injuries.

6 Claims, 3 Drawing Sheets

BELLOWS BEVERAGE LID

BACKGROUND OF THE INVENTION

1. Field of the Invention

The present invention relates to removable lids for beverage containers, and more particularly to a bellows beverage lid that incorporates a bellows into a removable lid to allow a user to cool the liquid in the container without removing the lid.

2. Description of the Related Art

Lids for hot beverage containers are known. Most lids are designed to snugly fit a disposable cup made for coffee or hot tea. A lid for a disposable cup generally has a hole or other opening so that a user can sip the hot liquid without removing the lid. Disposable lids and cups are most often seen at drive up or convenience stores and at fast food take-out restaurants, and the overwhelming majority are used for drinking coffee. Persons who wish to have their morning coffee while commuting in their personal vehicles or while using public transportation use many disposable lids and cups.

Because many individuals drink their hot beverages during their commute to work, it is desirable that the beverage remains hot for the duration of the trip. Anticipating that most individuals want their beverages, especially coffee, to remain hot, many take out establishments and other hot beverage purveyors pour these beverages at very high temperatures, often, as in the case with coffee, very close to boiling. Also, the smell and taste of coffee is heavily dependent on the oils and aromatic compounds that are dissolved out of the coffee beans during the brewing process. Many of these aromatic compounds have boiling points in the range of 150° to 160° Fahrenheit. Consequently coffee smells and tastes best when it is served and consumed at these high temperatures.

In addition, when a liquid is poured, there is an increase in surface area of the liquid so that the liquid is cooled. There is also a loss of heat when a hot beverage is poured into a cool container. If a consumer adds mild or cream and sugar there is a further loss of heat. If the consumer takes the beverage out from the store for later consumption, there is an additional decrease in temperature.

Current beverage container lids have performed quite adequately at heat retention and prevention of spillage. A consumer may find his or her coffee or tea too hot for personal comfortable consumption, however. Current disposable lids provide no way to regulate the temperature of the hot beverage in the container, other than removal of the lid to blow on the beverage or to add ice or cold water to the beverage.

Removal of a hot beverage lid is often not practical, especially if the consumer is driving a car or riding on a bus or subway. Removing the lid of a hot beverage container may result in a messy spill of the contents and can be a safety issue because hot beverages can cause serious injuries.

Thus, a bellows beverage lid solving the aforementioned problems is desired.

SUMMARY OF THE INVENTION

The bellows beverage lid according to the present invention is a lid for a hot beverage container that has a hole or port for sipping a hot beverage, a rim for securing the bellows beverage lid to the container, and a bellows portion on its exterior surface. Pushing on the bellows portion causes air to flow in and out of the container through the lid. The passage of air through the hole or port facilitates cooling of the liquid in the container.

This feature allows a user to cool the beverage or liquid held in the container to his or her personal liking by pushing on the bellows portion of the bellows beverage lid, without the necessity of removing the lid. Once the liquid inside the container is cooled to the user's satisfaction, or if the user does not wish to utilize the cooling feature, the bellows beverage lid functions as a normal lid for drinking a hot beverage from a cup.

The bellows beverage lid is particularly useful for take out hot drinks, such as coffee and tea, and practical for people who are commuting either by car or public transportation. The bellows beverage lid may be made to fit disposable containers, such as plastic coffee cups. The bellows beverage lid may also be adapted for a permanent container, such as refillable travel mugs, which are commonly sold as gas stations, coffee shops and convenience stores. The bellows beverage lid may also be adapted for containers holding microwavable soups or other instant food products.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
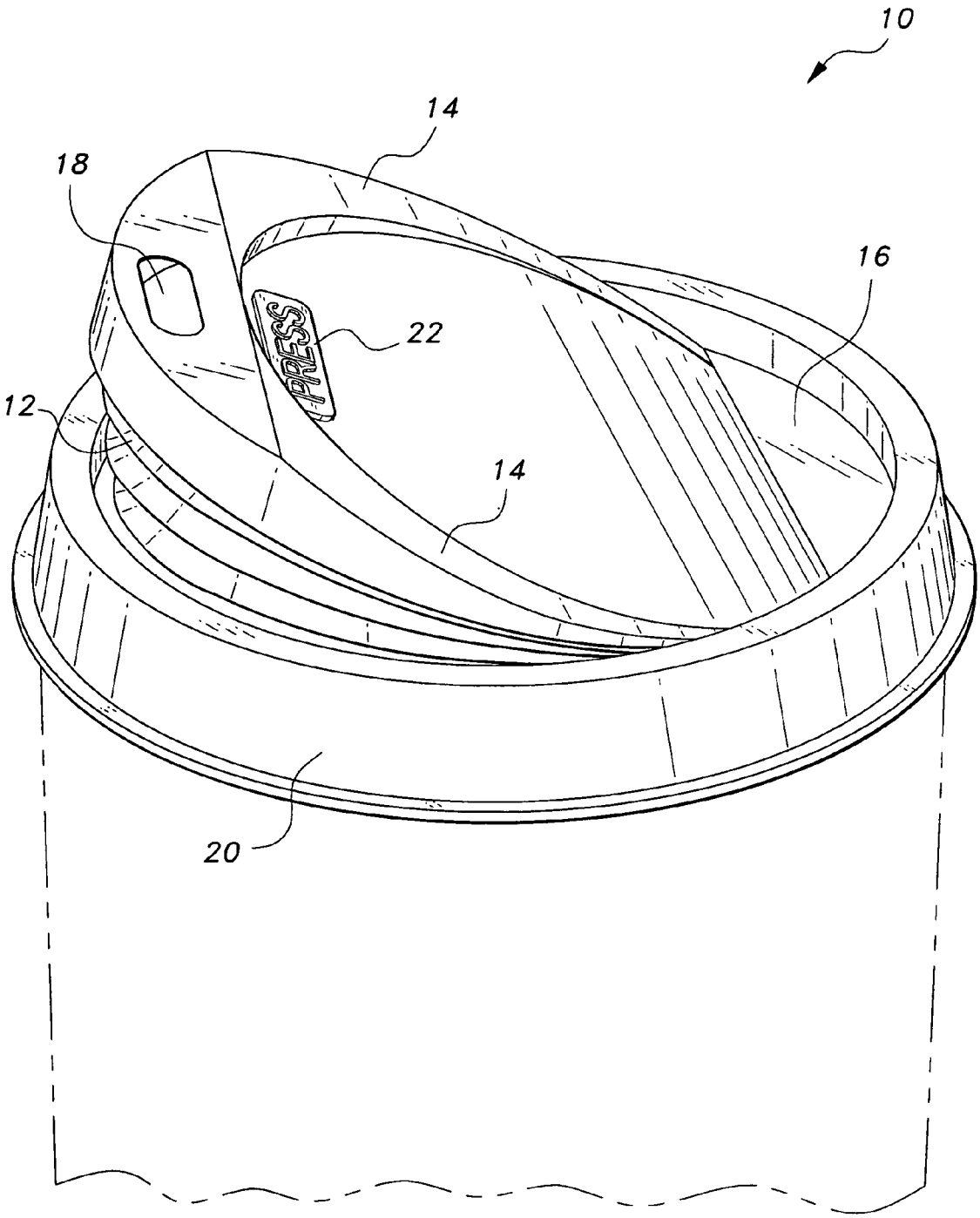
FIG. 1 is an environmental, perspective view of a bellows beverage lid according to the present invention.

The present invention relates to a bellows beverage lid, hereinafter designated as 10, adapted for use with hot beverage containers, and which allows a user to cool the hot beverage held in the container without the necessity of removing the bellows beverage lid 10. As the embodiment illustrated by FIG. 1 shows, the bellows beverage lid 10 has an annular rim 20 that defined an inverted groove configured to securely snap onto and hold the bellows beverage lid 10 to the rim of a beverage container, such as a coffee cup. The rim 20 encircles recessed a central portion that includes a fixed portion 16 and a bellows portion 12 hinged to the fixed portion 12. The bellows portion 12 is joined to the fixed portion 16 by a living hinge and may be raised or lowered by virtue of the flexible pleats defining the bellows 12, thereby retaining a cover over the beverage to avoid spillage whether the bellows portion is raised or lowered. A raised ridge 14 that functions as a lip rest is defined by the bellows portion 12. A port 18 for sipping a beverage and to allow airflow in and out of the container is defined along the outer perimeter of the bellows 12 opposite the living hinge. A button 22 for engaging the bellows portion 12 with a finger to compress the bellows 12 is defined on the exterior surface of the lid 10. The bellows beverage lid 10 is of integral, single piece construction, made from plastic or a similar material.

If a user determines that a liquid in a container is too hot for comfortable consumption, he or she may push on the button 22. The bellows portion 12 is resiliently biased upward to the raised position, but when the bellows portion 12 is pushed down, the bellows may be compressed to a lowered position substantially coplanar with the fixed portion 16. As the bellows 12 is repetitively raised and lowered, hot air from inside the container is pumped out through the port 18 by contraction of space within the container above the liquid. When the button 22 is released, the bellows portion 12 returns to its expanded position and cooler air from outside the container flows back into the container and cools the liquid held within. This action may be repeated as often as necessary until the beverage in the container reaches the desired temperature.

Figure 2:
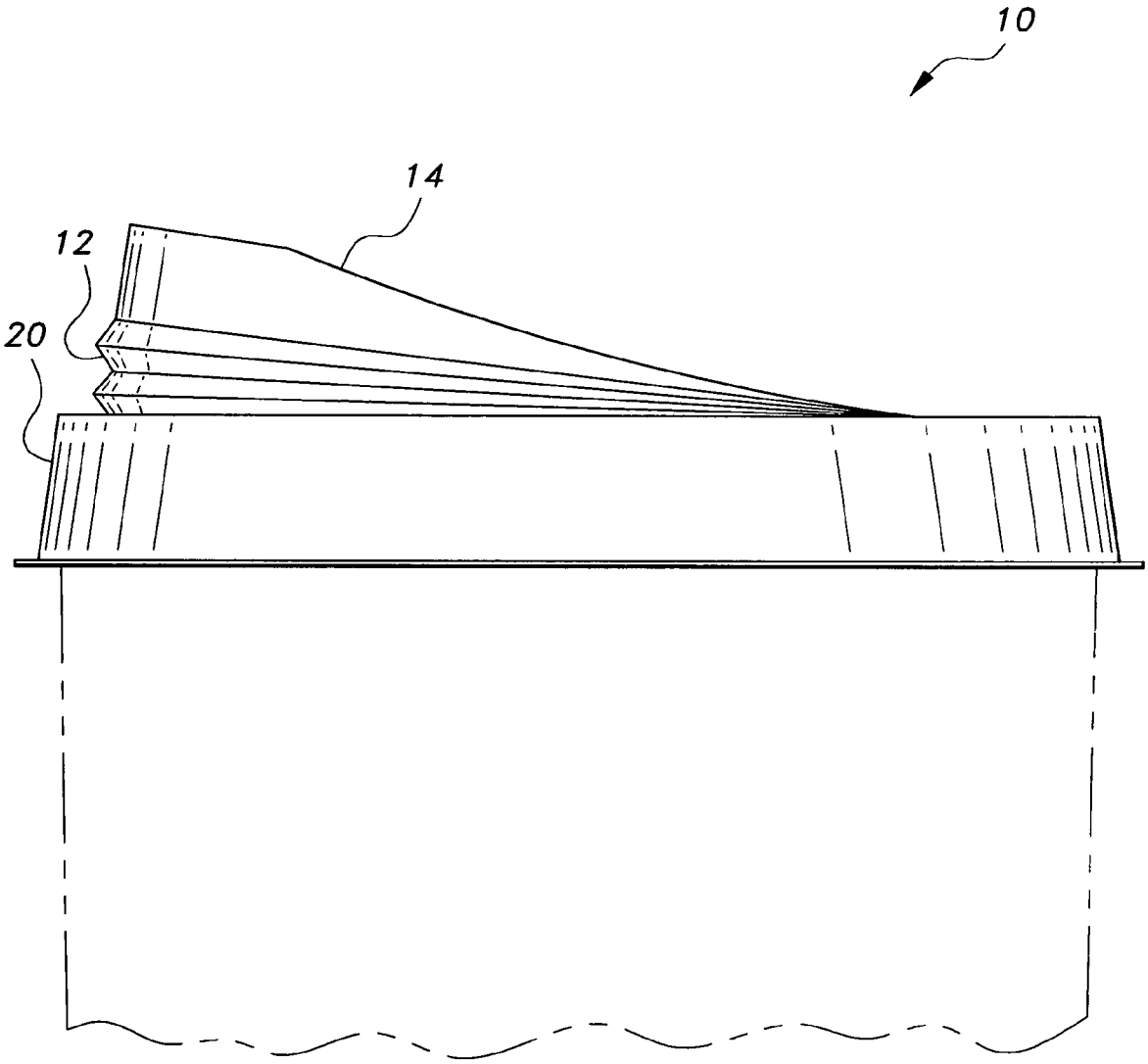
FIG. 2 is a side view of a bellows beverage lid according to the present invention.

Once the optimal temperature is achieved, the user simply sips the liquid from the port 18, using the raised ridge 14 as a convenient lip rest. The raised ridge 14 also functions to help prevent drips in case of accidental overfill or jostling of the container. FIG. 2 illustrates the bellows portion 12 of the bellows beverage lid 10 in its raised or expanded position.

Figure 3:
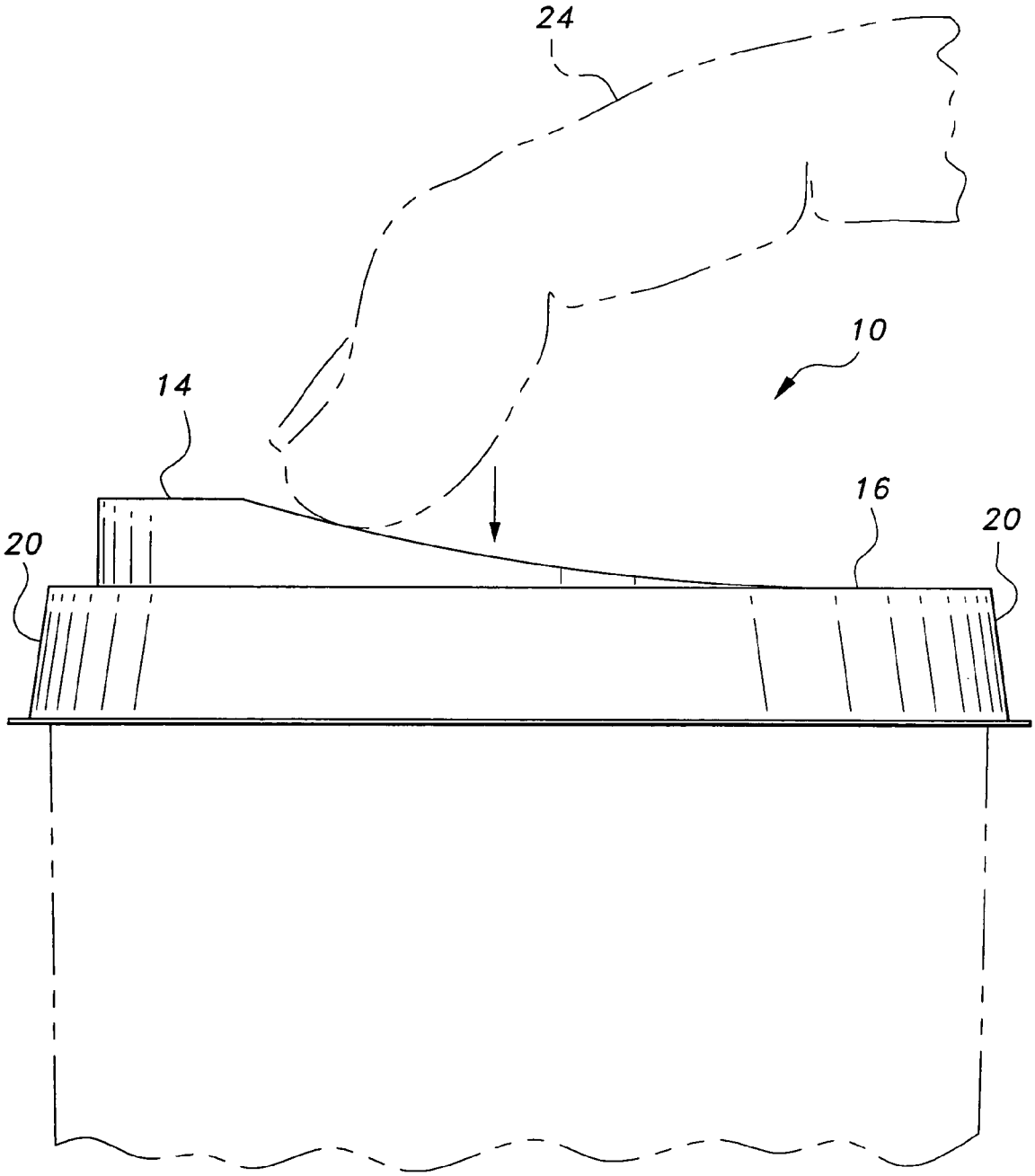
FIG. 3 is an environmental, side view of a bellows beverage lid according to the present invention, showing compression of the bellows.

FIG. 3 shows the bellows beverage lid 10 in the lowered or contracted position after the bellows portion 12 is pushed by a finger 28, forcing air out of the container. When the bellows beverage lid 10 is released, the bellows portion 12 resiliently returns to the position illustrated by FIG. 2.

Although the bellows beverage lid has been illustrated in this embodiment with a disposable beverage cup, such as those commonly used for coffee or hot tea, is will be understood that the bellows beverage lid 10 may be adapted for use with microwavable soup containers or other types of microwave or instant food products. The bellows beverage lid may also be adapted for use with permanent, non-disposable containers for hot liquids, such as commuter mugs designed for consuming beverages while traveling by automobile or other vehicle, commonly sold at gas stations and convenience stores.

It is to be understood that the present invention is not limited to the embodiments described above, but encompasses any and all embodiments within the scope of the following claims.

I claim:

1. A bellows beverage lid, comprising an annular rim adapted for attachment to a rim of a beverage container and a central beverage cover encircled by the annular rim, the central beverage cover being located above the annular rim and including a recessed fixed portion and a bellows portion pivotally attached to the fixed portion at its lower portion and defining a raised ridge at its upper portion, the bellows portion further defining a plurality of peripheral pleats disposed opposite the fixed portion and forming the outermost surface of the cover, wherein the pleats are contiguous to the annular rim, the bellows portion having a single unobstructed port located above the pleats and coplanar with the upper portion of the raised ridge for the passage and cooling of fluids therethrough, the bellows being resiliently biased to a raised position sloping upward from the recessed fixed portion and compressible to a lowered portion substantially coplanar with the fixed portion, the bellows being adapted for cooling the beverage by repetitively expanding and collapsing the bellows.

2. The bellows beverage lid according to claim 1, wherein said central beverage cover and said annular rim are integrally formed in a single piece.

3. The bellows beverage lid according to claim 1, further comprising a button formed on said bellows portion, the button being adapted for accommodating a user's finger.

4. The bellows beverage lid according to claim 1, wherein said bellows portion further comprises a raised ridge adapted for supporting a user's lip when drinking the beverage.

5. The bellows beverage lid according to claim 1, wherein said central beverage cover comprises a living hinge pivotally joining said bellows portion to said fixed portion.

6. A bellows beverage lid, comprising an annular rim adapted for attachment to a rim of a beverage container and a central beverage cover encircled by the annular rim, the central beverage cover being located above the annular rim and consisting of a recessed fixed portion and a bellows portion pivotally attached to the fixed portion at its lower portion and defining a raised ridge at its upper portion, the bellows portion further defining a plurality of peripheral pleats disposed opposite the fixed portion and forming the outermost surface of the cover, wherein the pleats are contiguous to the annular rim, the bellows portion having a single unobstructed port located above the pleats and coplanar with the upper portion of the raised ridge for the passage and cooling of fluids therethrough, the bellows being resiliently biased to a raised position sloping upward from the recessed fixed portion and compressible to a lowered portion substantially coplanar with the fixed portion, the bellows being adapted for cooling the beverage by repetitively expanding and collapsing the bellows.

* * * * *